US007975673B2

(12) United States Patent
Alajoki et al.

(10) Patent No.: US 7,975,673 B2
(45) Date of Patent: Jul. 12, 2011

(54) INJECTION ARRANGEMENT FOR A PISTON ENGINE

(75) Inventors: Juha Alajoki, Espoo (FI); Jukka Kiijärvi, Kylmälä (FI); Markus Niemi, Vantaa (FI); Jari Kostamo, Turenki (FI); Jyrki Kajaste, Nummela (FI); Pekka Hautala, Espoo (FI)

(73) Assignee: Wärtsilä Finland Oy, Vaasa (FI)

( * ) Notice: Subject to any disclaimer, the term of this patent is extended or adjusted under 35 U.S.C. 154(b) by 62 days.

(21) Appl. No.: 12/514,438

(22) PCT Filed: Nov. 13, 2007

(86) PCT No.: PCT/FI2007/050612

§ 371 (c)(1), (2), (4) Date: May 11, 2009

(87) PCT Pub. No.: WO2008/059113

PCT Pub. Date: May 22, 2008

(65) Prior Publication Data

US 2010/0050988 A1 Mar. 4, 2010

(30) Foreign Application Priority Data

Nov. 15, 2006 (FI) ..... 20065726

(51) Int. Cl.
*F02M 51/06* (2006.01)

(52) U.S. Cl. ..... 123/445; 123/490

(58) Field of Classification Search ..... 123/455, 123/490, 445, 446; 239/585.1; 251/129.1, 251/129.18, 129.2, 129.21, 129.22
See application file for complete search history.

(56) References Cited

U.S. PATENT DOCUMENTS

| | | | | |
|---|---|---|---|---|
| 5,019,119 | A * | 5/1991 | Hare, Sr. | 123/500 |
| 6,764,058 | B1 | 7/2004 | Brenk et al. | |
| 2007/0285195 | A1 * | 12/2007 | Nehl et al. | 335/209 |

FOREIGN PATENT DOCUMENTS

| | | | |
|---|---|---|---|
| DE | 19735232 | A1 | 2/1999 |
| DE | 10031277 | A1 | 1/2002 |
| DE | 102005003449 | A1 | 8/2006 |

* cited by examiner

*Primary Examiner* — Hai H Huynh
(74) *Attorney, Agent, or Firm* — Chernoff, Vilhauer, McClung & Stenzel

(57) ABSTRACT

A fuel injection arrangement for a piston engine, the arrangement comprising an injector nozzle (1) for injecting fuel into the combustion chamber (6) of the cylinder. A Theological actuator (15) is arranged in connection with the injector nozzle (1), the actuator comprising a space (18) containing Theological fluid and an apparatus (19, 20) by means of which the viscosity of the Theological fluid can be changed for controlling the fuel injection.

17 Claims, 2 Drawing Sheets

INJECTION ARRANGEMENT FOR A PISTON ENGINE

This is a national stage application filed under 35 USC 371 based on International Application No. PCT/FI2007/050612 filed Nov. 13, 2007, and claims priority under 35 USC 119 of Finnish Patent Application No. 20065726 filed Nov. 15, 2006.

The present invention relates to an injection arrangement for a piston engine, the arrangement comprising an injection nozzle for injecting fuel into the combustion chamber of a cylinder.

The present invention also relates to a method of injecting fuel into a cylinder of a piston engine.

The injector nozzle injects fuel as finely atomized mist into the combustion chamber of a diesel engine so that combined with turbulence of air good mixing of fuel and combustion air is achieved and as complete a combustion as possible. The fuel, atomized into small droplets by the nozzle, is quickly evaporated as the combustion begins after a small ignition delay. Usually a spring-loaded needle is used as a closure means of the injector nozzle, whereby as short a fuel injection time and high injection pressure for producing as fine a fuel spray as possible and an exact timing of the start and end of the fuel injection are achieved. The nozzle is opened by the fuel pressure produced by the high pressure pump. The closing of the nozzle is ensured by means of a pressure valve of the high pressure pump, the valve suddenly lowering the pressure in the injector tube as the injection ends.

Typical problems in injector nozzles having a spring-loaded needle are leakages via the tip of the needle as the nozzle is closed and sticking of the nozzle in the open position, whereby fuel can constantly get into the cylinder. This causes starting problems of the engine, increase of emissions, noise and fuel consumption and, in the worst case, even a breakdown of the engine. In order to avoid damages, the engine usually has to be stopped in case of injector nozzle leak. Often it is also difficult to adjust the injection volume, timing and duration of the injection in injector nozzles.

The object of the invention is to produce an improved fuel injection arrangement for a piston engine.

The aim of the invention is achieved by means of an injection arrangement according to claim 1. The injection arrangement according to the invention comprises a rheological actuator arranged in connection with the injector nozzle, the actuator comprising a space, such as a channel, containing rheological fluid, and an apparatus for changing the viscosity of the rheological fluid for controlling the fuel injection.

The rheological fluid can be magnetorheological and/or electrorheological, whereby the change of viscosity is caused by means of a magnetic and/or electric field acting on the fluid.

Considerable advantages are achieved by means of the invention.

There is no need to stop the engine in case of injector nozzle leak, but instead the high-pressure pump of the injection system is switched off, whereby fuel flows to the injector nozzle in low pressure provided by the low-pressure pump of the system. In the injector nozzle, the rheological actuator increases the pressure to a level suitable for the injection. The amount of fuel flowing to the cylinder between the injections is so low that there is no need to stop the engine.

The amount of fuel injected into the combustion chamber of the cylinder as well as duration and timing of injection can be adjusted to exactly meet the requirements by controlling the rheological actuator. The flow properties of the rheological fluid change fast as the field applied to the fluid changes, whereby the actuator is very fast in operation.

In the following, the invention is disclosed in more detail by means of examples according to the appended drawings.

Figure 1:
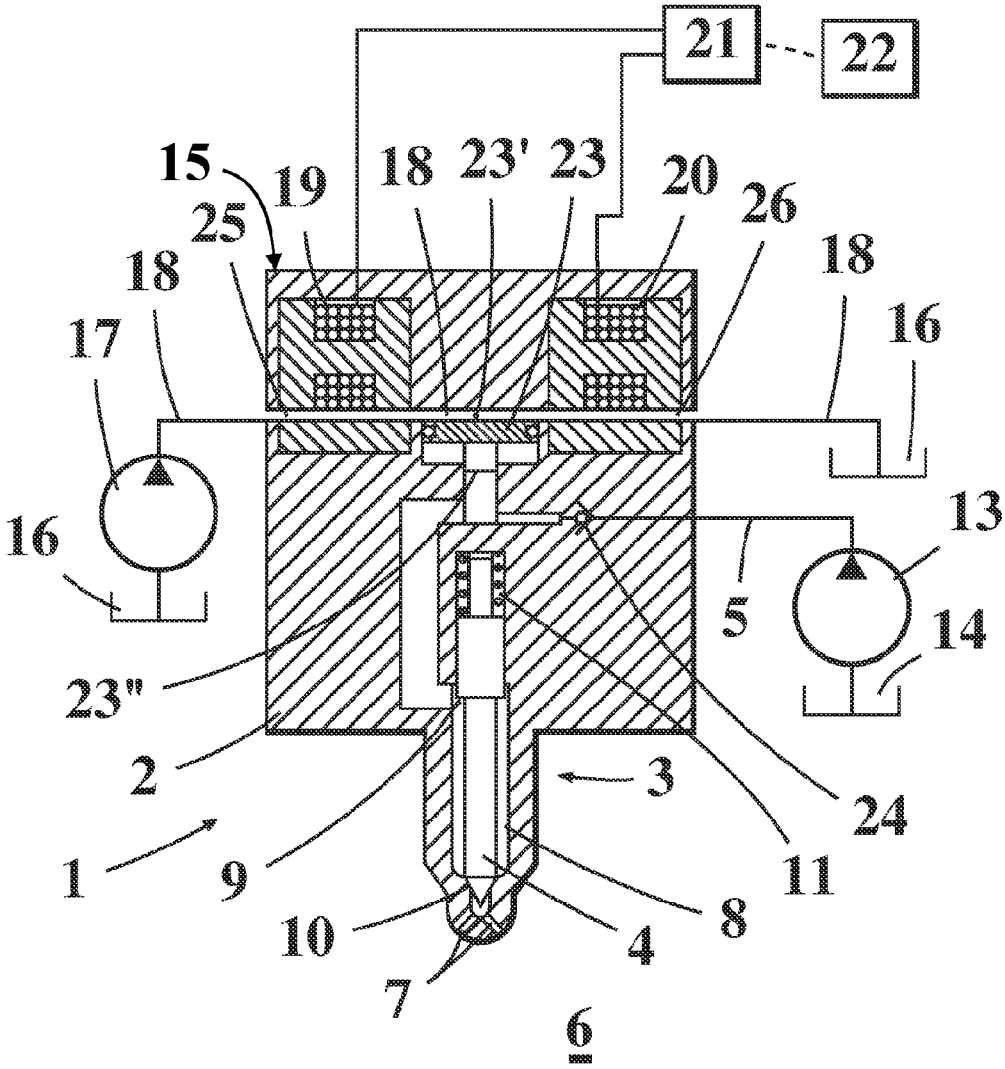
FIG. 1 is a schematic cross-section of an injection arrangement according to the invention.

The injection arrangement shown in FIG. 1 comprises an injector nozzle 1 arranged in connection with the cylinder head for injecting fuel into the combustion chamber 6 of the cylinder of the engine. A valve 3 is arranged in the body 2 of the injector nozzle 1 for injecting fuel. The valve 3 comprises a movable needle 4 by means of which the fuel injection via the nozzle openings 7 into the combustion chamber 6 of the cylinder is controlled. The needle 4 is arranged in connection with a fuel chamber 8, which is limited at its top portion by a projection 9 acting as a piston surface. The body 2 comprises a sealing surface 10 against which the needle 4 is pressed by means of a spring 11. When the needle 4 is against the sealing surface 10, the valve is closed.

Fuel is pumped with a low-pressure pump 13 from the fuel tank 14 via fuel channel 5 to the injector nozzle chamber 8. Typically, the fuel pressure is increased by means of the low-pressure pump to about 5 bar. The injector nozzle 1 comprises a rheological actuator 15 comprising a space, such as a channel, containing rheological fluid, and an apparatus for changing the viscosity of the rheological fluid for controlling the fuel injection. The rheological actuator is used for increasing the fuel pressure so as to suit the injection as described below. When the force applied by the fuel pressure on the projection 9 exceeds the force applied by the spring 11 on the needle 4, the valve 3 opens and fuel is admitted into the combustion chamber 6 between the needle 4 and the sealing surface 10 and via the nozzle openings 7. When the force applied by the fuel pressure on the projection 9 decreases to below the force applied by the spring 11 on the needle 4, the needle 4 moves back against the sealing surface 10 and the valve 3 is closed, whereby the fuel injection into the combustion chamber 6 ends. The fuel channel 5 is provided with a check valve 24 allowing flow only in one direction, i.e. from the low-pressure pump 13 towards the chamber 8.

The rheological actuator 15 comprises a tank 16 for magnetorheological fluid and a pump 17 for recycling the fluid in the actuator 15 along a flow channel 18. The actuator 15 further comprises a first control coil 19 and a second control coil 20 for applying a magnetic field to the magnetorheological fluid in the flow channel 18. The control coils 19, 20 are arranged in connection with the flow channel 18 so that they are located at a distance from each other. The pressure of the magnetorheological fluid is applied on the first surface 23', i.e. the top surface, of the piston 23 arranged in connection with the flow channel 18 between control coils 19, 20. The pressure of the fuel in fuel channel 5 is applied to the bottom surface of the piston 23, i.e. the second surface 23", more exactly the fuel pressure prevailing in the portion of the fuel channel 5 between the check valve 24 and the chamber 8. The first surface 23' and the second surface 23" are on the opposing sides of the piston 23, whereby the pressure force acting on the first surface 23' is directionally opposite to the pressure force acting on the second surface 23".

Both control coils 19, 20 are connected to the current source 21 from which electric current is introduced to the control coils 19, 20. A magnetic field is formed in the channel 18 at the location of the control coils 19, 20 due to the influence of the electric current. The intensity of the magnetic field depends on the intensity of the current introduced into coils 19, 20. The introduction of current from the power source 21 to the control coils 19, 20 is controlled by means of control signals emitted by the control unit 22. Thus, the control unit 22 determines the intensity of the current introduced into the coils 19, 20 as well as the duration and timing of the current feed. The control unit 22 controls the feed of the current on the basis of, for example, the operation of the engine. The control unit 22 can be programmed to emit control signals at desired moments on the basis of the work cycle of the engine, e.g. on the basis of signals from a sensor monitoring the rotation of the engine crankshaft. The controls can also take into account the changes in the loading and engine speed and change the amount of injected fuel and the duration and timing of the injection on the basis thereof.

A magnetorheological fluid is a functional fluid, which normally is in liquid state and flowing. The rheological properties of a magnetorheological fluid change on the basis of the magnetic field applied to the fluid. A magnetorheological fluid contains basic liquid having magnetic particles. Water, oil or glycol, among others, can be used as basic liquid. The magnetic particles are, for example, iron or copper particles. The properties of the fluid depend on the size of the particles, the change of rheological properties of a fluid containing a large amount of small particles as the strength of the magnetic field changes is stronger than the change of fluid containing a large amount of large particles. The diameter of particles in a magnetorheological fluid is at the most 10 μm, typically about 0.1-5 μm. The percentage by volume of particles of the total volume of the magnetorheological fluid is at least 20%, typically 20-40%.

When a magnetic field is applied to a magnetorheological fluid, its viscosity increases. At the same time the flow resistance of the fluid increases. In case the magnetic field is strong enough, the fluid turns gelatinous and non-flowing. Under the influence of the magnetic field the dipoles of the magnetic particles settle in a parallel manner into the magnetic field and form chains resisting the flow of fluid. When the magnetic field applied to the fluid is removed, an opposite phenomenon takes place, i.e. the fluid turns back into a flowing substance. Thereby the particles settle randomly in the fluid. The change of viscosity of a magnetorheological fluid happens quickly in both directions, typically in a few microseconds.

During the operation of the injector nozzle 1 the opening and closing of the valve 3 is effected by means of increasing and decreasing the fuel pressure in the chamber 8 by means of a magnetorheological actuator 15. Fuel is pumped by means of the low-pressure pump 13 to the fuel channel 5 in a pressure of about 5 bar. The pressure of the fuel in the chamber 8 is increased to suit the injection by controlling the electric currents introduced to the control coils 19, 20. The magnetorheological fluid is pumped from the tank 16 to the flow channel 18 by means of a pump 17. The injection is effected by switching current to the second control coil 20, whereby the magnetorheological fluid is solidified in the flow channel 18 at the location of the second control coil 20, in more detail at the location of the second control edge 26, and it forms a flow resistance. Thereby the pressure of the magnetorheological fluid acting on the first surface 23' of the piston 23 increases. The first control coil 19 is kept currentless, whereby the first control edge 25 situated at its location forms a small flow resistance for the magnetorheological fluid flowing in the flow channel 18. When the pressure force applied to the first surface 23' of the piston 23 exceeds the pressure force applied to the second surface 23", the piston starts to move downwards, increasing the pressure of the fuel in the chamber 8 so as to exceed the pressure produced by means of the low-pressure pump 13. When the fuel pressure in the chamber 8 increases enough, the lifting force exerted by the needle 4 on the projection 9 exceeds the spring force pressing the needle 4 against the sealing surface 10 and the tip of the needle 4 is lifted away from the sealing surface 10, whereby fuel flows between the needle 4 and the sealing surface 10 and through the nozzle openings 7 into the combustion chamber 6. The amount of fuel injected into the combustion chamber 6 depends on the travel of the piston 23, which is adjustable by means of currents introduced into the control coils 19, 20. By changing the intensity and timing of the currents introduced to the control coils 19, 20 the duration and timing of the injection as well as the feed velocity of the fuel can also be adjusted steplessly.

The injection of fuel into the combustion chamber 6 ends when the currents of the control coils 19, 20 are changed so that the force applied by the magnetorheological fluid on the upper surface 23' of the piston 23 decreases. The introduction of current to the second control coil 20 is interrupted and current is switched on to the first control coil 19, whereby the magnetorheological fluid solidifies in the flow channel 18 at the point of the first control coil 19, in more detail at the point of the first control edge 25, and it forms a flow resistance. The flow resistance is reduced at the second control coil 20 and magnetorheological fluid flows from the flow channel 18 to the tank 16. Thus the pressure of the magnetorheological fluid in the flow channel 18 is reduced. When the force exerted by the fuel pressure on the needle 4 decreases below the spring force exerted by the spring 11 on needle 4, the spring 11 presses the needle 4 back against the sealing surface 10 and the valve 3 closes. Simultaneously, the pressure in the fuel channel 5 lifts the piston 23, thus increasing the amount of fuel inside the injector nozzle 1. When the piston 23 has lifted sufficiently, the injector nozzle 1 is ready for a new injection.

The injection operation can be, for example, main injection, pre-injection prior to main injection or post-injection subsequent to the main injection. In pre-injection, a small amount of fuel is introduced into the cylinder prior to the main injection. Pre-injection is accomplished when a small current is introduced into the second control coil 20, whereby the needle 4 slowly rises from the sealing surface 10. Prior to full opening of the valve 3 the introduction of current to the second control coil 20 is interrupted and a large current is introduced into the first control coil 19, whereby pressure in the flow channel 18 is reduced and the valve 3 closes quickly. Main injection is accomplished by introducing a large current to the second control coil 20, whereby the valve 3 quickly opens. After a desired time the introduction of current to the second control coil 20 is interrupted and the introduction of current to the first control coil 19 is started, whereby the valve 3 closes. Post-injection is accomplished similarly to pre-injection.

The embodiment according to FIG. 1 can be used in injection arrangements comprising, in addition to the low-pressure pump, a separate high-pressure pump. An injector nozzle of this type is preferably a so-called pump injector, in which the high-pressure pump is integrated in the injector nozzle 1. During the normal operation of the injector nozzle 1 the pressure of the fuel pumped by the low-pressure pump is increased by means of a high-pressure pump to suit the injection. During normal operation the magnetorheological actuator 15 is deactivated, i.e. control coils 19, 20 are currentless. In malfunction situations, such as fuel leaks between the tip of the needle 4 and the sealing surface 10 into the combustion chamber 6 while the valve 3 is closed or when the valve 3 does not close properly, the high-pressure pump is switched off and the fuel pressure provided by the low-pressure pump 12 is increased to suit the injection with the magnetorheological actuator 15. Similar operation is also possible in case the high-pressure pump is damaged. The fuel pressure is changed by means of the magnetorheological actuator 15 as described in the above example.

Figure 2:
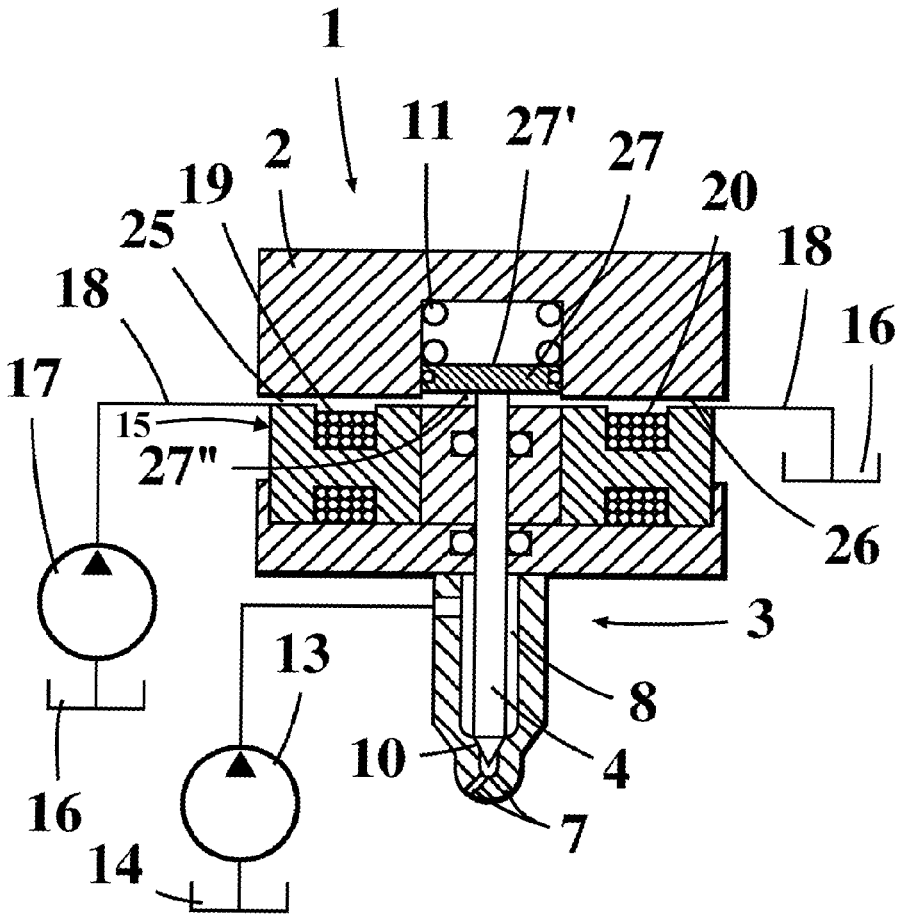
FIG. 2 is a schematic cross-section of another injection arrangement according to the invention.

In the embodiment of FIG. 1 the force moving the needle 4 is produced by means of a magnetorheological actuator 15 by indirectly changing the pressure of the fuel in fuel chamber 8. FIG. 2 shows an embodiment in which the force of the magnetorheological actuator is applied directly onto the needle 4. In this embodiment the needle 4 is pressed against the sealing surface 10 with a spring 11. Piston 27 is located in the upper end of the needle 4, and the spring force is applied on the top surface, i.e. first surface 27' of the piston. The force caused by the pressure of the magnetorheological fluid of the flow channel 18 of the magnetorheological actuator 15 is applied to the bottom surface of the piston 27, i.e. the second surface 17". The first surface 27' and the second surface 27" are on the opposite sides of the piston 27, whereby the spring force and the force caused by the magnetorheological fluid acting on piston 27 are opposite to each other. The magnetorheological actuator 15 is controlled correspondingly by means of control coils 19, 20 as in the embodiment of FIG. 1. When current is switched on to the second control coil 20, a flow resistance is formed on the location of the second control edge 26, whereby the pressure of the magnetorheological fluid increases below the piston 27 in the flow channel 18. Injection of fuel into the combustion chamber 6 takes place when the force applied by the magnetorheological fluid to the lower surface 27' of the piston 27 increases the spring force applied to the upper surface 27' of the piston 27 exceeds the spring force and other forces restraining the lifting of the needle 4, whereby the valve 3 opens and fuel flows between the needle 4 and the sealing surface 10 and through the nozzle openings 7 into the combustion chamber 6. The injection of fuel ends when the pressure force caused by the magnetorheological fluid against the second surface 27" of the piston is reduced so that the spring 11 presses the needle 4 back against the sealing surface 10.

The invention has embodiments differing from what is described above.

Instead of magnetorheological fluids or in addition thereto other kinds of rheological fluids, such as electrorheological or electromagnetorheological fluid, can be used in an injection arrangement according to the invention, the viscosity properties of the fluid being controllably changeable by changing the strength of the electric and/or magnetic field applied to the fluid. In this case the arrangement uses instead of coils apparatuses, such as capacitors for forming an electric field, by means of which the desired field and field strength can be caused. As with magnetorheological fluids, the flow properties of other rheological fluids can be controllably changed by means of an electric or magnetic field acting on the fluid. The rheological fluid includes basic liquid and small particles. Depending on the strength of the field applied to the fluid, the viscosity of the rheological fluid can be changed from watery to nearly solid in a few microseconds. When the field applied to the fluid is removed, the particles settle randomly and the fluid returns to its basic state just as quickly.

The embodiments according to FIGS. 1 and 2 can be used in the same injection arrangement. Thus, the pressure of the rheological fluid in flow channel 18 is used for changing the pressure of the fuel in fuel chamber 8 for accomplishing injection, as in the embodiment of FIG. 1. Further, the rheological fluid in flow channel 18 applies to the needle 4 a pressure force for accomplishing injection, as in the embodiment of FIG. 2.

The invention claimed is:

1. A fuel injection arrangement for a piston engine, the arrangement comprising an injector nozzle (1) for injecting fuel into the combustion chamber (6) of a cylinder, a rheological actuator (15) arranged in connection with the injector nozzle (1), the actuator (15) comprising a space (18) containing rheological fluid, characterized in that the rheological actuator (15) comprises two apparatuses (20) for changing the viscosity of the rheological fluid for controlling the fuel injection, the first apparatus (19) being arranged to control the flow of the rheological fluid into the space (18) and the second apparatus (20) being arranged to control the flow of rheological fluid away from the space (18).

2. An injection arrangement according to claim 1, characterized in that the injector nozzle (1) comprises a spring-loaded needle (4) being in connection with a fuel chamber (8) for the fuel to be injected.

3. An injection arrangement according to claim 2, characterized in that the pressure of the rheological fluid in space (18) applies to the needle (4) a pressure force directionally opposite to the spring force applied to the needle (4).

4. An injection arrangement according to claim 3, characterized in that the needle (4) comprises a piston surface (27) to which the pressure of the rheological fluid in the space (18) is applied.

5. An injection arrangement according to claim 1, characterized in that the rheological actuator (15) is arranged to change the pressure of the fuel in the fuel chamber (8) for accomplishing injection.

6. An injection arrangement according to claim 5, characterized in that the pressure change of the rheological fluid in space (18) causes a change of fuel pressure in the fuel chamber (8) for accomplishing injection.

7. An injection arrangement according to claim 1, characterized in that the rheological fluid is magnetorheological fluid.

8. An injection arrangement according to claim 1, comprising a pump for inducing a continuos flow of rheological fluid into the space.

9. An injection arrangement according to claim 1, wherein the injector nozzle comprises a spring-loaded needle extending within a fuel chamber for the fuel to be injected, the rheological actuator comprises a piston having a piston surface exposed to the rheological fluid in the space, and the piston is functionally coupled to the needle.

10. An injection arrangement according to claim 9, wherein the needle is attached to the piston whereby the needle moves with the piston.

11. An injection arrangement according to claim 1, wherein the injector nozzle comprises a spring-loaded needle extending within a fuel chamber for the fuel to be injected, movement of the needle is influenced by pressure in the fuel chamber, and the rheological actuator comprises a piston having a first piston surface exposed to the rheological fluid in the space and a second, opposite, piston surface exposed to pressure in the fuel chamber, whereby movement of the piston influences pressure in the fuel chamber.

12. A method of injecting fuel into the cylinder of a piston engine, in which method fuel is injected into the combustion chamber (6) of a cylinder by means of an injector nozzle (1), in connection with which a rheological actuator (15) is arranged, the actuator comprising a space (18) containing rheological fluid, and wherein the fuel injection is controlled by changing the viscosity of the rheological fluid, characterized in that the rheological actuator comprises two apparatuses (19, 20) for changing the viscosity of the rheological fluid, and that the flow of the rheological fluid into the space (18) is controlled by the first apparatus (19) and the flow of rheological fluid away from the space (18) is controlled by the second apparatus (20).

13. A method according to claim 12, characterized in that the injector nozzle (1) comprises a spring-loaded needle (4) being in connection with a fuel chamber (8) for the fuel to be injected and that the rheological actuator (15) is used for changing the pressure of the fuel in the fuel chamber (8).

14. A method according to claim 13, characterized in that the fuel pressure in the fuel chamber (8) is changed by changing the pressure of the rheological fluid in the space (18).

15. A method according to claim 12, characterized in that the injector nozzle (1) comprises a spring-loaded needle (4) being in connection with a fuel chamber (8) for the fuel to be injected and that the pressure of the rheological fluid in the space (18) applies to the needle (4) a pressure force directionally opposite to the spring force for accomplishing injection.

16. A method according to claim 12, characterized in that magnetorheological fluid is used as the rheological fluid.

17. A method according to claim 12, comprising employing a pump to induce continuously the flow of rheological fluid into the space.

* * * * *